United States Patent [19]

Nagashima et al.

[11] Patent Number: 5,066,569

[45] Date of Patent: Nov. 19, 1991

[54] METHOD OF PROCESSING SILVER HALIDE PHOTOGRAPHIC MATERIALS

[75] Inventors: Toshiharu Nagashima; Kazuhiro Yoshida, both of Hino, Japan

[73] Assignee: Konica Corporation, Tokyo, Japan

[21] Appl. No.: 615,177

[22] Filed: Nov. 19, 1990

[30] Foreign Application Priority Data

Nov. 20, 1989 [JP] Japan ..... 1-301423

[51] Int. Cl.[5] ..... G03C 5/38

[52] U.S. Cl. ..... 430/393; 430/400; 430/455; 430/567; 430/963

[58] Field of Search ..... 430/393, 400, 455, 567, 430/963

[56] References Cited

U.S. PATENT DOCUMENTS 4,756,996 7/1988 Debruyn, Jr. ..... 439/455
4,876,180 10/1989 Abe et al. ..... 430/393
4,945,036 7/1990 Arai et al. ..... 430/567

FOREIGN PATENT DOCUMENTS 383283 8/1990 European Pat. Off. ..... 430/963

OTHER PUBLICATIONS

Patent Abstracts of Japan: vol. 12, No. 231 (P-723) (3078) 30 Jun. 1988, and JP-A-63 023148 (Fuji Photo Film Co. Ltd.) 30 Jan. 1988.
EP-A-0308193 (Konica Corporation), Abstract.
EP-A-0316864 (Konica Corporation), Abstract.
Patent Abstracts of Japan: vol. 12, No. 415 (P-781)(3262) 04 Nov. 1983, and JP-A-63 151943 (Fuji Photo Film Co. Ltd.) 24 Jun. 1988.
EP-AA-0238271 (Konishiroku Photo Industry Co. Ltd.).

*Primary Examiner*—Hoa Van Le
*Attorney, Agent, or Firm*—Finnegan, Henderson, Farabow, Garrett, and Dunner

[57] ABSTRACT

In the improved method of processing an imagewise exposed silver halide photographic material that has photographic constituent layers on a side of a support with an automatic processor, comprising:

circulating a fixing solution in a fixing bath being discharged in a volume of 30-200% per minute of a capacity of said fixing bath and at a flow rate of not less than 20 m per minute, wherein said silver halide photographic material has a gelatin content of not more than 3.0 g/m$^2$ in said photographic constituent layers, and said photographic constituent layers comprise a silver emulsion layer which contains silver halide grains having a (100) face to (111) face area ratio of not less than 5.

17 Claims, No Drawings

METHOD OF PROCESSING SILVER HALIDE PHOTOGRAPHIC MATERIALS

BACKGROUND OF THE INVENTION

This invention relates to a method of processing silver halide photographic materials, more particularly, to a method that is capable of processing silver halide photographic materials in a shorter period of time.

A persisting need in the fields of handling silver halide photographic materials has been to shorten the process time so as to realize rapid processing. To take plate-making operations in the printing industry as an example, the efforts to increase the operational efficiency and to streamline the process have been remarkable and this has raised the need to shorten the time for processing light-sensitive materials for printing. In response to this need, various studies are being conducted in order to shorten the time required for processing light-sensitive materials. However, the ideas proposed so far are merely based on shortening the length of process line or increasing the line speed (the speed at which the light-sensitive material to be processed is transported) and various problems occur if these approaches alone are taken. Outstanding problems are insufficient fixation (i.e., not all silver is removed as a result of fixation) and the poor storage stability of processed light-sensitive materials. The performance of processed materials has also been found to deteriorate in other ways as evidenced by lower sensitivity, color remnant and decrease in contrastiness.

SUMMARY OF THE INVENTION

The present invention has been accomplished with a view to solving the aforementioned problems of the prior art and it has as its principal object providing a method by which silver halide photographic materials can be processed in a shorter period of time as accompanied by efficient removal of silver in the fixing step, good storage stability of the processed light-sensitive materials and production of image with reduced color remnant.

The present invention relates to an improvement of a method of processing an imagewise exposed silver halide photographic material that has photographic constituent layers on a side of a support with an automatic processor, comprising:

circulating a fixing solution in a fixing bath being discharged in a volume of 30–200% per minute of a capacity of said fixing bath and at a flow rate of not less than 20 m per minute, wherein said silver halide photographic material has a gelatin content of not more than 3.0 g/m$^2$ in said photographic constituent layers, and said photographic constituent layers comprise a silver emulsion layer which contains silver halide grains having a (100) face to (111) face area ratio of not less than 5.

The present invention has been accomplished on the basis of this finding.

The theoretical aspect of the present invention that relates to the accomplishment of the object of the present invention has not been fully elucidated but it was indeed surprising and unexpected for the present inventors that the object of the present invention could be achieved by a processing method having the features described above.

DETAILED DESCRIPTION OF THE INVENTION

The light-sensitive material to be processed by the method of the present invention has photographic constituent layers including one or more silver halide emulsion layers on at least one side of a support. Other aspects of the arrangement of layers to be used in the present invention are in no way limited; the light-sensitive material may have on one side of a support a plurality of photographic constituent layers including at least one silver halide emulsion layer, with another layer, for example, a backing layer being provided on the other side. Alternatively, it may have photographic constituent layers including at least one silver halide emulsion layer on either side of the support. It is essential that the photographic constituent layers have at least one silver halide emulsion layer and they may also contain non-light-sensitive layers such as a protective layer, intermediate layers and an anti-halation layer. The number of silver halide emulsion layers to be provided is in no way limited and two or more silver halide emulsion layers may be formed.

The light-sensitive material to be processed by the method of the present invention has a gelatin deposit of no more than 3.0 g/m$^2$ in the photographic constituent layers containing silver halide emulsion layers, and at least one of the silver halide emulsion layers contains silver halide grains having a (100) face to (111) face area ratio of at least 5. The value of gelatin deposit in photographic constituent layers refers to the gelatin deposit on one side of a support. Preferably, the gelatin deposit in the photographic constituent layers containing silver halide emulsion layers is no more than 2.8 g/m$^2$, with the value of no more than 2.5 g/m$^2$ being more preferred.

The silver deposit in the emulsion layers is preferably at least 3.0 g/m$^2$, more preferably at least 3.5 g/m$^2$. The efficiency of silver removal in the fixing step is generally low if the silver deposit is high but in accordance with the present invention, sufficient silver removal is insured even if the silver deposit is no less than 3.0 g/m$^2$.

The silver halide grains to be used in the present invention have a (100) face to (111) face ratio of at least 5 and they may be totally bounded by (100) faces. The (100) face to (111) face area ratio of silver halide grains can be measured by a dye adsorption method using the Kubelka-Munk relationship. The dye to be used in this method is such that it adsorbs preferentially on either a (100) or a (111) face, producing different spectra in the cases of dye association on the two faces, with such a dye being added to an emulsion of interest, the spectra for the amount of dye addition are closely investigated to determine the (100) face to (111) face area ratio of the silver halide grains in the emulsion.

The exact proportion of the surfaces of silver halide grains occupied by (100) faces can be determined by the method described in T. Tani, "Identification of the Crystal Phase of Silver Halide Grains in Photographic Emulsion Using the Phenomenon of Dye Adsorption", Nikkashi (Journal of the Chemical Society of Japan), 6, 942–946 (1984).

Silver halide grains having a (100) face to (111) face area ratio of at least 5 can be prepared by various methods. A generally preferred method is a "controlled double-jet method" in which with the pAg being held at a constant value of no more than 8.10 during grain formation, an aqueous solution of silver nitrate and an aqueous solution of an alkali halide are added simultaneously at a rate that is greater than the rate of dissolution of grains and that insures substantial re-nucleation. A more preferred value of pAg is no more than 7.80, with the value of no more than 7.60 being particularly preferred. If it is supposed that the formation of silver halide grains consists of two phases, the formation and growth of nuclei, the pAg for nucleation is not limited to any particular value but the pAg for the growth of nuclei is preferably no greater than 8.10, more preferably no greater than 7.80, most preferably no greater than 7.60. A soluble silver salt may be reacted with a soluble halogen salt by a single-jet method but a double-jet method is more preferred in order to achieve a higher level of monodispersity.

The silver halide grains to be used in the present invention may be octahedral, tetradecahedral, duodecahedral or otherwise shaped particles that are prepared by the methods described in such references as U.S. Pat. Nos. 4,183,756, 4,225,666, JP-A-55-26589 (the term "JP-A" as used hereinafter means an "unexamined published Japanese patent application"), JP-B-55-42737 (the term "JP-B" as used hereinafter means an "examined Japanese patent publication"), and J. Photgr. Sci., 21, 39 (1973). Particles having twinned faces may also be used.

The silver halide grains to be used in the present invention may have a single crystallographic shape or they may be mixtures of variously shaped particles.

The silver halide grains to be used in the present invention preferably have an average grain size of no more than 0.4 μm, with the range of 0.1–0.35 μm being more preferred. Silver halide emulsion grains having a (100) face to (111) face area ratio of at least 5 preferably account for at least 50%, more preferably at least 80%, of all the silver halide grains present in the silver halide emulsion layer. The average size of silver halide grains is generally used as the average grain size of an emulsion containing those grains. The term "grain size" as used herein has the definition described below and should be measured by the method described below.

Emulsions containing the silver halide grains to be used in the present invention may have any size distribution; an emulsion having a broad size distribution (which is hereinafter referred to as a "polydispersed emulsion") may be used or emulsions having a narrow size distribution (which are referred to as "monodispersed emulsions") may be used either singly or as admixtures. If desired, a polydispersed emulsion may be used in admixture with a monodispersed emulsion.

Two or more silver halide emulsions as prepared separately may be used in admixture.

Monodispersed emulsions are preferably used in the present invention. The monodispersed silver halide grains in a monodispersed emulsion are preferably such that the weight of grains having sizes within ±20% of the average size r accounts for at least 60%, more preferably at least 70%, most preferably at least 80%, of the total weight of the grains.

The term "average size r" as used herein may be defined as the grain size ri for the case where the product of ni and $ri^3$ attains a maximum value (in $ni \times ri^3$, ni represents the frequency of the occurrence of grains having the size ri) and it is expressed in three significant figures, with a figure of the least digit being rounded off. The term "grain size" as used herein means the diameter of a spherical silver halide grain, or the diameter of the projected area of a non-spherical grain as reduced to a circular image of the same area.

Grain size may be determined by a direct measurement of the diameter of a grain of interest or its projected area on a print obtained by photographic imaging of that grain under an electron microscope at a magnification of $1\text{–}5 \times 10^4$ (supposing that the grains to be measured are randomly selected to a total number of at least 1,000).

A highly monodispersed emulsion which is particularly preferred for use in the present invention has a monodispersity of no greater than 20, more preferably no greater than 15, as calculated by the following formula:

$$\text{Monodispersity} = \frac{\text{Standard deviation of grain size}}{\text{Average grain size}} \times 100$$

where the average grain size and the standard deviation of grain size shall be determined from ri which was already defined above. Monodispersed emulsions can be obtained by making reference to such prior patents as JP-A-54-48521, 58-49938 and 60-122935.

Silver halides to be contained in the silver halide emulsion layer(s) in the photographic material to be processed by the method of the present invention may be selected from among any types that are used in conventional silver halide emulsions, as exemplified by silver bromide, silver chloride, silver iodobromide, silver chlorobromide and silver chloroiodobromide. Preferably, silver halide emulsions having a silver chloride content of at least 50 mol % are used.

The silver halide grains to be used in the present invention may have a uniform distribution of silver halide composition in their interior, or they may be core/shell grains having different silver halide compositions in the interior and surface layer of the grain. Latent image may be formed chiefly on the surface or in the interior of grains.

The light-sensitive silver halide emulsions to be used in the present invention may be a "primitive" one which has not been subjected to chemical sensitization. If desired, those emulsions may be chemically sensitized by various methods that are described by Glafkides or Zelikman et al. or described in Die Grundlagen der Photographischen Prozesse mit Silverhalogeniden, ed. by H. Frieser, Akademische Verlagsgesellschaft, 1968.

Methods of chemical sensitization that can be used in the present invention include: sulfur sensitization which uses sulfur-containing compounds or activated gelatins which are capable of reacting with silver ions; reduction sensitization which uses reducing materials; and noble metal sensitization which uses gold and other noble metals. Exemplary sulfur sensitizers include thiosulfates, thioureas, thiazoles, rhodanines, etc. and specific examples of these compounds are described in U.S. Pat. Nos. 1,574,944, 2,410,689, 2,278,947, 2,728,668 and 3,656,955. Exemplary reduction sensitizers include stannous salts, amines, hydrazine derivatives, formamidosulfinic acid, silane compounds, etc. and specific examples of these compounds are described in U.S. Pat. Nos. 2,487,850, 2,419,974, 2,518,698, 2,983,609, 2,983,610 and 2,694,637. For noble metal sensitization, not only gold complex salts but also complex salts of metals of group VII of the periodic table (e.g. platinum, iridium and palladium) may be used and specific examples of these complex salts are described in U.S. Pat. Nos. 2,399,083, 2,448,060 and U.K. Patent No. 618,061.

There are no particular limitations on pH, pAg, temperature and other conditions of chemical sensitization. The pH value is preferably in the range of 4–9, more preferably 5–8; the pAg value is preferably held in the range of 5–11, more preferably 7–9; and the temperature is preferably in the range of 40°–90° C., more preferably 45°–75° C.

The sulfur sensitization or gold-sulfur sensitization described above may be combined with reduction sensitization or noble metal sensitization to chemically sensitize the silver halide emulsion to be used in the present invention.

After completion of the chemical sensitization described above, 4-hydroxy-6-methyl-1,3,3a,7-tetraazaindene, 5-mercapto-1-phenyl-tetraazole, 2-mercaptobenzothiazole and various other stabilizers may be used in the practice of the present invention. If necessary, silver halide solvents such as thioether or crystal habit modifiers such as mercapto group containing compounds and sensitizing dyes may also be employed.

In the process of formation and/or growth of silver halide grains, metal ions may be added in the form of cadmium, zinc, lead, thallium or iridium salt (or a complex salt containing the same), a rhodium salt (or a complex salt containing the same) or an iron salt (or a complex salt containing the same) so that these metallic elements may be present within and/or on the grains.

In the preparation of silver halide emulsions to be used in the present invention, unwanted soluble salts may be removed after completion of the growth of silver halide grains. If desired, such soluble salts may be left unremoved from the grown silver halide grains. Removal of such soluble salts may be accomplished by the method described under Research Disclosure No. 17643.

Special sensitizers may also be added to the silver halide photographic material to be processed by the present invention. Applicable dyes include cyanine dyes, merocyanine dyes, complex cyanine dyes, complex merocyanine dyes, holopolar cyanine dyes, hemicyanine dyes, styryl dyes and hemioxanole dyes. Particularly useful dyes are those which are classified as cyanine dyes, merocyanine dyes and complex merocyanine dyes. These dyes may contain any of the nuclei that are customarily used as basic heterocylic nuclei in cyanine dyes. Specific examples of such nuclei include: a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei having alicyclic hydrocarbon rings fused to these nuclei; and nuclei having aromatic hydrocarbon rings fused to these nuclei, as exemplified by an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have one or more substituents on the carbon atom.

Merocyanine or complex merocyanine dyes may contain nuclei having a ketomethylene structure and such nuclei include 5- or 6-membered heterocyclic nuclei as emplified by a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus.

If speotral sensitizers are to be used in the present invention, their concentrations should be comparable to those employed in ordinary nagative-working silver halide emulsions. It is particularly preferred that spectral sensitizers are used at dye concentrations that will not cause a substantial decrease in the intrinsic sensitivity of the silver halide emulsions. Spectral sensitizers are preferably used at concentrations of from ca. $1.0\times10^{-5}$ to ca. $5\times10^{-4}$ moles, more preferably from ca. $4\times10^{-5}$ to ca. $2\times10^{-4}$ moles, per mole of silver halide.

The spectral sensitizers described above may be used either on their own or as admixtures. More specific examples of spectral sensitizers that may be used with advantage in the present invention are listed below: those to be used in blue-sensitive silver halide emulsions (see patents such as West German Patent No. 929,080, U.S. Pat. Nos. 2,231,658, 2,493,748, 2,503,776, 2,519,001, 2,912,329, 3,656,956, 3,672,897, 3,694,217, 4,025,349, 4,046,572, U.K. Patent No. 1,242,588, JP-B-44-14030, 52-24844, and JP-A-48-73137 and 61-172140); those to be used in green-sensitive silver halide emulsions as typified by cyanine dyes, merocyanine dyes and complex cyanine dyes of the types described in such patents as U.S. Pat. Nos. 1,939,201, 2,072,908, 2,739,149, 2,945,763, U.K. Patent No. 505,979 and JP-B-48-42172; and those to be used in red-sensitive or infrared-sensitive silver halide emulsions as typified by cyanine dyes, merocyanine dyes and complex cyanine dyes of the types described in such patents as U.S. Pat. Nos. 2,269,234, 2,270,378, 2,442,710, 2,454,629, 2,776,280, JP-B-49-17725, JP-A-50-62425, 61-29836 and 60-80841.

These spectral sensitizers may be used either on their own or as admixtures. Combinations of spectral sensitizers are often used for the purpose of supersensitization and typical examples are described in such patents as U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, U.K. Patent Nos. 1,344,281, 1,507,803, JP-B-43-4936, 53-12375, and JP-A-52-110618 and 52-109925.

The silver halide photographic material of the present invention may contain water-soluble dyes in hydrophilic colloidal layers either as filter dyes or for attaining various objects such as prevention of irradiation or halation. Such water-soluble dyes include oxonole dyes, hemioxonole dyes, styryl dyes, merocyanine dyes, cyanine dyes, azo dyes, etc. Among these dyes, oxanole dyes, hemioxanole dyes and merocyanine dyes are particularly useful.

Dyes, uv absorbers and other additives present in hydrophilic colloidal layers in the silver halide photographic material to be processed by the present invention may be mordanted with cationic polymers or the like.

In order to prevent the occurrence of sensitivity drop or fogging during the production, storage or processing of silver halide photographic materials, various compounds may be incorporated in the photographic emulsion described above. Many compounds known as stabilizers may be used for this purpose and they include: azoles such as benzothiazolium salts, nitroindazoles, triazoles, benzotriazoles and benzimidazoles (in particular, those which are substituted by nitro or halogen); heterocyclic mercapto compounds such as mercaptothiazoles, mercaptobenzimidazoles, mercaptothiazoles, mercaptotetrazoles (in particular, 1-phenyl-5-mercaptotetrazole), mercaptopyridines, and those heterocyclic mercapto compounds having water-soluble groups such as a carboxyl group or a sulfone group; thioketo compounds such as oxazolinethione; azaindenes such as tetrazaindenes [in particular, 4-hydroxy-substituted(1,3-,3a,7) tetrazaindenes]; benzenethiosulfonic acids; and benzenesulfinic acids.

Several examples of the applicable compounds are listed, with pertinent references being also mentioned, in K. Mees, "The Theory of the Photographic Process", 3rd Ed., Macmillan Publishing Co., Inc., 1966.

For more specific examples of the applicable compounds and for the methods of using them, reference may be had to U.S. Pat. Nos. 3,954,474, 3,982,947, 4,021,248 and JP-B-52-28660.

The silver halide photographic material of the present invention may contain alkyl acrylate latices in photographic constituent layers as described in U.S. Pat. Nos. 3,411,911, 3,411,912, and JP-B-45-5331.

The silver halide photographic material to be processed by the present invention may also contain various additives as shown below: a thickener or plasticizer selected from among styrene-sodium maleate copolymer, dextran sulfate, etc. as described in U.S. Pat. No. 2,960,404, JP-B-43-4939, West German Patent Application (DAS) No. 1,904,604, JP-A-48-63715, Belgian Patent No. 762,833, U.S. Pat. No. 3,767,410, Belgian Patent No. 588,143, etc.; a hardener selected from among aldehydes, epoxies, ethyleneimines, activated halogens, vinylsulfones, isocyanates, sulfonate esters, carbodiimides, mucochloric acids, acyloyls, etc.; and a uv absorber selected from among the compounds described in U.S. Pat. No. 3,253,921 and U.K. Patent 1,309,349, in particular, 2-(2'-hydroxy-5-tert-butylphenyl)-benzotriazole, 2-(2'hydroxy-3',5'-di-tert-butylphenyl)-benzotriazole, 2-(2-hydroxy-3'-tert-butyl-5'-butylphenyl)-5-chlorobenzotriazole and 2-(2'-hydroxy-3',5'-di-tert-butylphenyl)-5-chlorobenzotriazole. As coating aids, emulsifiers, agents to provide improved permeability of processing solutions and other fluids, antifoaming agents or as surfactants to be used for controlling various physical properties of the light-sensitive material, anionic, cationic, nonionic or amphoteric compounds of the types described in the following patents may be employed: U.K. Patent Nos. 548,532, 1,216,389, U.S. Pat. Nos. 2,026,202, 3,514,293, JP-B-44-26580, 43-17922, 43-17926, 43-3166, 48-20785, French Patent No. 202,588, Belgian Patent No. 773,459, JP-A-48-101118, etc. Among these compounds, anionic surfactants having a sulfone group such as sulfonated succinate esters and alkylbenzenesulfonates are particularly preferred. Compounds useful as antistats are described in such patents as JP-B-46-24159, JP-A-48-89979, U.S. Pat. Nos. 2,882,157, 2,972,535, JP-A-48-20785, 48-43130, 48-90391, JP-B-46-24159, 46-39312, 48-43809, JP-A-47-33627, etc.

Coating solutions to be used in producing silver halide photographic materials preferably have a pH in the range of 5.3–7.5. When a plurality of layers are to be formed in superposition, the coating solution prepared by mixing the coating solutions for the respective layers in their predetermined proportions preferably have a pH within the above-stated range of 5.3–7.5. If the pH is lower than 5.3, the applied coating will harden at an unacceptably slow speed, whereas the photographic performance of the final product will be adversely affected if the pH is higher than 7.5.

Photographic constituent layers of the light-sensitive material may incorporate a matting agent selected from among the following: the particles of inorganic materials such as silica as described in Swiss Patent No. 330,158, a glass Powder as described in French Patent No. 1,296,955, alkaline earth metals or carbonates of cadmium, zinc, etc. as described in U.K. Patent No. 1,173,181; and the particles of organic materials such as starch as described in U.S. Pat. No. 2,322,037, as well as starch derivatives as described in Belgian Patent No. 625,451 or U.K. Patent No. 981,198, polyvinyl alcohol as described in JP-B-44-3643, polystyrene or polymethyl methacrylate as described in Swiss Patent No. 330,158, polyacrylonitrile as described in U.S. Pat. No. 3,079,257, and polycarbonates as described in U.S. Pat. No. 3,022,169.

Photographic constituent layers of the light-sensitive material may also contain a slip agent selected from among the following: higher aliphatic acid esters of higher alcohols as described in U.S. Pat. Nos. 2,588,756 and 3,121,060; casein as described in U.S. Pat. No. 3,295,979; calcium salts of higher aliphatic acids as described in U.K. Patent No. 1,263,722; and silicon compounds as described in U.K. Patent No. 1,313,384 and U.S. Pat. Nos. 3,042,522 and 3,489,567. Dispersions of liquid paraffins can also be used as slip agents.

Depending upon a specific object, the light-sensitive material to be processed by the present invention may incorporate various additives. A detailed description of useful additives is given in Research Disclosure, Item 17643 (December 1978) and ibid., Item 18716 (November 1979) and the relevant portion of the description is summarized in the table below.

| | Additive | RD 17643 | RD 18716 |
|---|---|---|---|
| 1. | Chemical sensitizer | p. 23 | p. 648, right col. |
| 2. | Sensitivity improver | | p. 648, right col. |
| 3. | Spectral sensitizer supersensitizer | pp. 23–24 | p. 648, right col. to p. 649, right col. |
| 4. | Brightener | p. 24 | |
| 5. | Antifoggant Stabilizer | pp. 24–25 | p. 649, right col. |
| 6. | Light absorber Filter dye UV absorber | pp. 25–26 | p. 649, right col. to p. 650, left col. |
| 7. | Antistain agent | p. 25 right col. | p. 650, left and right col. |
| 8. | Dye image stabilizer | p. 25 | |
| 9. | Hardener | p. 26 | p. 651, left col. |
| 10. | Binder | p. 26 | p. 651, left col. |
| 11. | Plasticizer Lubricant | p. 27 | p. 650, right col. |
| 12. | Coating aid Surfactant | pp. 26–27 | p. 650, right col. |
| 13. | Antistat | p. 27 | p. 650, right col. |

In the silver halide photographic materials to be processed by the method of the present invention, emulsion layers and other photographic constituent layers may be embodied by being coated on either one or both sides of flexible supports that are commonly employed in photographic materials. Useful flexible supports include: films made of semisynthetic or synthetic polymers such as cellulose nitrate, cellulose acetate, cellulose acetate butyrate, polystyrene, polyvinyl chloride, polyethylene terephthalate and polycarbonates; and paper coated or laminated with baryta layer or α-olefinic polymers (e.g. polyethylene, polypropylene and ethylene-butene copolymer). These supports may be tinted with dyes or pigments. They may be rendered black for light-shielding purposes. The surface of these supports is normally subbed in order to provide improved adhesion to emulsion layers or other constituent layers. For preferred methods of subbing, reference may be had to JP-A-52-104913, 59-18949, 59-19940 and 59-11941.

Before or after subbing, the surface of the supports may be subjected to corona discharge treatment, uv irradiation, flame treatment or some other appropriate treatment.

Photographic emulsion layers and other hydrophilic colloidal layers that are to make up the silver halide photographic material to be processed by the present invention may be applied onto the support or other layers by a variety of coating techniques, such as dip coating, roller coating, curtain coating and extrusion coating.

The processing of silver halide photographic materials according to the present invention is further described below. After imagewise exposure, the photographic materials are processed with an automatic processor. In a preferred embodiment, the processing consists of development, fixing, washing and drying steps.

In the method of the present invention, a light-sensitive material is processed at a line speed that is preferably at least 1,000 mm/min, more preferably at least 1,500 mm/min and most preferably at least 1,800 mm/min.

The processing method of the present invention employs an automatic processor. The processor that can be used may be of any type or model and a roller-transport processor may be mentioned as an example. Details of such automatic processors are described in such patents as U.S. Pat. Nos. 3,025,779 and 3,545,971, Automatic processors of this type are generally composed of units that respectively perform four steps, development, fixing, washing and drying, and the method of the present invention is preferably carried out through these steps. The processing units, particularly the fixing bath, in automatic processors is usually equipped with a circulating means such as a pump.

In the present invention. each of the fixing and development times is preferably no longer than 20 seconds, more preferably no longer than 15 seconds. The washing time is preferably no longer than 10 seconds.

In the practice of the present invention, the fixing solution circulating in the fix bath is discharged in a volume of 30–200%, preferably 50–150%, more preferably 60–120%, of the bath capacity per minute. If the volume discharged is less than 30% of the bath capacity per minute, the efficiency of silver removal decreases to an undesirably low level. If the volume discharged exceeds 200% of the bath capacity per minute, the surface of the fixing solution in the bath will be disturbed to cause occasional splashes to get into the developing bath, whereby the processing efficiency can deteriorate. In the present invention, the fixing solution being discharged flows at a rate of at least 20 m/min, preferably 40–200 m/min. If the flow rate of the fixing solution being discharged is 20 m/min or more, satisfactory processing is realized although the exact reason for such results is not known. Probably, adequate effects of agitation would be obtained at flow rates of 40 m/min and above.

The discharge volume of the fixing solution circulating in the fixing bath is the volume of the fixing solution being discharged from the fixing bath, and the "bath capacity" means the volume of the fixing solution charged in the fixing bath, which is usually equivalent to the volume of the fixing solution with which the fixing bath is filled. The flow rate of the fixing solution being discharged may be defined by the following formula:

$$\text{Flow rate (m/min)} = \frac{\text{(Total volume of circulating fixing solution being discharged with pump) } m^2/\text{min}}{\text{(Total aperture area of discharging outlet) } m^2}.$$

The pH of the fixing solution is preferably 4.0–6.0, with the range of 4.3–5.5 being more preferred.

While various developing agents may be incorporated in the black-and-white developing solution to be used in the present invention, the combinations of dihydroxybenzenes and 1-phenyl-3-pyrazolidones are most preferred. Needless to say, p-aminophenolic developing agents may also be used.

Exemplary dihydroxybenzene developing agents include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, with hydroquinone being particularly preferred.

Exemplary 1-phenyl-3-pyrazolidone compounds and derivatives thereof that can be used as developing agents in the present invention include 1-phenyl-4,4-dimethyl-3-pyrazolidone, 1-phenyl-4-methyl-4-hydroxymethyl-3-pyrazolidone and 1-phenyl-4,4-dihydroxymethyl-3-pyrazolidone.

Exemplary p-aminophenolic developing agents that can be used in the present invention include N-methyl-p-aminophenol, p-aminophenol, N-($\beta$-hydroxyethyl)-p-aminophenol, N-(4-hydroxyphenyl)glycine, 2-methyl-p-aminophenol and p-benzylaminophenol, with N-methyl-p-aminophenol being particularly preferred.

The developing agents described above are preferably used in amounts ranging from 0.01 to 1.2 moles per liter.

Exemplary sulfites that can be used as preservatives in the present invention include sodium sulfite, potassium sulfite, lithium sulfite, ammonium sulfite, sodium bisulfite, potassium metabisulfite and formaldehyde sodium bisulfite. These sulfites are preferably used in amounts of at least 0.2 moles per liter, with 0.4 moles/L or more being particularly preferred. The upper limit is preferably no more than 2.5 moles/L.

The developing solution to be used in the present invention preferably has a pH in the range of 9 to 13, with the range of from 10 to 12 being more preferred.

Alkali agents used for pH setting include pH adjusters such as sodium hydroxide, potassium hydroxide, sodium carbonate, potassium carbonate, sodium tertiary phosphate and potassium tertiary phosphate.

Buffering agents may also be used and they include borates (see JP-A-61-28708), saccharose, acetoxime and 5-sulfosalicylic acid (for these three, see JP-A-60-93439), phosphates and carbonates.

Other additives that may be incorporated include: development restrainers such as sodium bromide, potassium bromide and potassium iodide; organic solvents such as ethylene glycol, diethylene glycol, triethylene glycol, dimethylformamide, methyl cellosolve, hexylene glycol, ethanol and methanol; and antifoggants as exemplified by mercapto compounds such as 1-phenyl-5-mercaptotetrazole and sodium 2-mercaptobenzimidazole-5-sulfonate, indazole compounds such as 5-nitroindazole, and benzotriazole compounds such as 5-methyl benzotriazole. If necessary, tone modifiers, surfactants, antifoaming agents, water softeners and amino compounds (see JP-A-56-106244) may also be contained.

In accordance with the present invention, the developing solution may contain an anti-silver stain agent such as the compound described in JP-A-56-2434. The developing solution may also contain an amino compound such as the alkanolamine described in JP-A-56-106244.

Other developing solutions that may be employed in the present invention are described in such references as L. F. A. Mason, "Photographic Processing Chemistry", The Focal Press, PP. 226-229, 1966, and U.S. Pat. Nos. 2,193,015, 2,592,364, and JP-A-48-64933.

The term "development time" as used herein means the time required for the light-sensitive material of interest being immersed in the solution in the development tank of an automatic processor to be immersed in the fixing bath, and the term "fixing time" as used herein means the time required for the light-sensitive material immersed in the solution in the fixing tank to be immersed in the solution in the washing water tank (or stabilizing tank).

The term "washing time" means the time for which the light-sensitive material is immersed in the solution in the washing water tank.

The term "drying time" means the time for which the light-sensitive material is in the drying zone of the automatic processor where hot air having a temperature of ca. 35°-100° C., preferably 40°-80° C., is blown against the material.

The development temperature and time are respectively from ca. 25° to 50° C. and 15 seconds or shorter, with the preferred ranges being from 30° to 40° C. and from 5 to 15 seconds.

The fixing solution is an aqueous solution containing a thiosulfate. Illustrative fixing agents are sodium thiosulfate and ammonium thiosulfate. Since thiosulfate ion and ammonium ion are essential components of fixing agents, ammonium thiosulfate is particularly preferred from the viewpoint of fixing speed. The amount of fixing agents used is properly adjustable and is generally within the range of from ca. 0.1 to ca. 6 moles/L.

Fixing solutions may contain water-soluble aluminum salts that work as hardeners and illustrative water-soluble aluminum salts are aluminum chloride, aluminum sulfate and potassium alum.

Fixing solutions may contain tartaric acid, citric acid or derivatives thereof either on their own or as admixtures. It is effective for these compounds to be contained in an amount of at least 0.005 moles per liter of the fixing solution, with the range of 0.01-0.03 moles/L being particularly preferred. Specific examples of tartaric acid, citric acid and derivatives thereof include tartaric acid, potassium tartrate, sodium tartrate, potassium sodium tartrate, citric acid, sodium citrate, potassium citrate, lithium citrate and ammonium citrate.

If desired, the fixing solution may also contain a preservative (e.g. sulfite or disulfite), a pH buffer (e.g. acetic acid or nitric acid), a pH adjuster (e.g. sulfuric acid), a chelatant capable of softening hard water, or the compound described in Japanese Patent Application No. 60-213562.

The fixing temperature and time are preferably within the ranges of from ca. 20° to ca. 50° C. and up to 20 seconds, with the ranges of 30°-40° C. and 5-15 seconds being particularly preferred.

If a concentrated fixing solution is additionally supplied together with diluting water therefor as the light-sensitive material is processed with an automatic processor by the method of the present invention, said concentrated fixing solution which is usually a two-component system may be composed of a single component. A single-component concentrated fixing solution can usually remain stable at a pH of 4.3 and above. If the pH is less than 4.3, the thiosulfate will be decomposed to become eventually sulfidized, particularly in the case where said solution is left to stand for a prolonged period before the fixing solution is put to actual use. If the pH is 4.3 and above, only a limited amount of sulfurous acid gas will evolve and the working environment will remain clean. There is no strict limitation on the maximum level of pH but if fixing is performed at excessively high pH, the hydrophilic colloidal layers of the light-sensitive material will have an unduly high pH even if it is subsequently washed with water and the layers will swell so greatly as to increase the water load to be dried. Therefore, the upper limit of the pH of the fixing solution is generally set at about 7. With fixing solutions that harden the film by means of aluminum salts used as acidic hardeners, the upper limit of their pH should be no higher than 5.5 in order to prevent precipitation of the aluminum salts.

In implementing the method of the present invention, either one of the developing and fixing solutions may be a so-called "working solution" that does not require diluting water of the type described above and which hence may be supplied undiluted.

The amounts in which the respective concentrated solutions are supplied into the associated processing tanks and the proportions in which they are mixed with diluting water may be varied widely depending upon the compositions of the respective concentrated solutions. Normally, the ratio of each concentrated solution to diluting water is in the range of from 1:0 to 1:8, and the total amount of each solution to be supplied (i.e. the developing or fixing solution) preferably ranges from 50 ml to 1,500 ml per square meter of the light-sensitive material. In a preferred embodiment, the fixing solution may be supplied in an amount not exceeding 300 ml.

In the preferred embodiment of the present invention, the developed and fixed light-sensitive material is then subjected to a washing and/or stabilizing treatment, which may be carried out by every method known in the art. Water containing various additives known in the art may be used as washing water or the stabilizing solution. For instance, if water that has been rendered mold-proof is used as washing water or the stabilizing solution, not only does it become possible to reduce the water supply (i.e. no more than 3 liters of water need be supplied per square meter of the light-sensitive material) but also the piping for the automatic processor can be simplified. In addition, the number of stock tanks can be reduced. Stated more specifically, the washing water (and diluting water for conditioning the developing and fixing solutions as required) or stabilizing solution can be supplied from a single common stock tank, thus realizing further reduction in the size of the automatic processor.

If water rendered mold-proof is used in combination with the washing water or stabilizing solution, the buildup of scale in the latter can be prevented, thereby accomplishing a reduction in the water supply by 0-3 liters, preferably 0–1 liter, per square meter of the light-sensitive material. The "zero" replenishment refers to the case where the washing water in the wash tank is not replenished at all except for the compensation for the loss that occurs by such reason as evaporation with time.

The classical method for reducing the amount of water to be supplied additionally is by employing a countercurrent system through two, three or more stages. If this multi-stage countercurrent system is applied to the present invention, the light-sensitive material in the fixing solution will be brought through successive contact stages in the "clean" direction, namely, toward the processing solution that is less contaminated by the fixing solution, thereby accomplishing much more efficient washing. According to this technique, thiosulfates and other labile compounds will be effectively removed to further reduce the possibility of color change or fading, thus providing even marked stabilizing effects. As another advantage, the amount of washing water that is required is appreciably reduced as compared to the prior art.

If washing is to be effected with a small amount of wash water, it is preferred to employ a washing tank provided with squeeze rollers as described in Japanese Patent Application No. 60-172968.

An overflow will emerge from the washing or stabilizing bath when it is replenished with the mold-proof water as required for the processing of the light-sensitive material. As described in JP-A-60-235133, part or all of this overflow may be recycled to the previous step as a processing solution having the fixing capability. By so doing, the stock water that is necessary can be reduced and in addition, the amount of effluent can also be reduced.

Water can be rendered mold-proof by various methods including the uv irradiation described in JP-A-60-263939, the method using a magnetic field as described in JP-A-60-263940, the method which produces pure water by means of an ion-exchange resin as described in JP-A-61-131632, and the method which employs a biocide as described in Japanese Patent Application Nos. 60-253807, 60-295894, 61-63030 and 61-51396.

These methods may be employed in combination with a biocide, mold inhibitor, a surfactant or the like as described in L. E. West, "Water Quality Criteria", Photo. Sci. & Eng., Vol. 9, No. 6 (1965), M. W. Beach, "Microbiological Growths in Motion-Picture Processing", SMPTE Journal, Vol. 85 (1976), R. O. Deegan, "Photo Processing Wash Water Biocides", J. Imaging Tech., Vol. 10, No. 6 (1984), as well as JP-A-57-8542, 57-58143, 58-105145, 57-132146, 58-18631, 57-97531 and 57-157244.

The washing bath may further contain one or more of the following compounds as microbiocides: isothiazoline compounds of the type described in R. T. Kreiman, J. Imaging Tech., 10, 6, p. 242 (1984), isothiazoline compounds of the type described in Research Disclosure, vol. 205, Item 20526, May 1981, isothiazoline compounds of the type described in Research Disclosure, ibid., vol. 228, Item 22845, April 1983, and the compounds described in Japanese Patent Application No. 61-51396.

Specific examples of mold inhibitors that can be used include phenol, 4-chlorophenol, pentachlorophenol, cresol, o-phenylphenol, chlorophene, dichlorophene, formaldehyde, glutaraldehyde, chloroacetamide, p-hydroxybenzoic acid esters, 2-(4-thiazoline)-benzimidazole, benzisothiazolin-3-one, dodecyl-benzyl-dimethylammonium chloride, N-(fluorodichloromethylthio)-phthalimide, and 2,4,4'-trichloro-2'-hydroxydiphenylether.

For the purpose of space saving, mold-proof water preserved in a water stock tank is preferably used not only as diluting water for stocking processing solutions (e.g. the above-mentioned developer and fixing solution) but also as washing water. If desired, mold-proof diluting water and washing water (or stabilizing solution) may be stored in different tanks or only one of them may be supplied as tap water.

If mold-proof diluting water and washing water (or stabilizing solution) are to be stored in different tanks, various additives may be incorporated in the mold-proof washing water (or stabilizing solution). Exemplary additives that can be incorporated are chelating compounds having a log K value (i.e., a measure of the stability of a chelate with aluminum) of at least 10. These chelate compounds are effective in preventing the formation of white precipitate in the washing water when the fixing solution contains an aluminum compound as hardener. Specific examples of the chelate compound that can be used include ethylenediaminetetraacetic acid (log K, 16.1; the value in parentheses that follow denote log K), cyclohexanediaminetetraacetic acid (17.6), diaminopropanotetraacetic acid (13.8), diethylenetriaminepentaacetic acid (18.4), triethylenetetraminehexaacetic acid (19.7), etc., as well as sodium, potassium and ammonium salts thereof. These compounds are preferably added in amounts of 0.01–10 g/L, more preferably 0.1–5 g/L.

Besides silver image stabilizers, various surfactants may be incorporated in the wash water in order to prevent the occurrence of water spots. The surfactants to be used for this purpose may be cationic, anionic, nonionic or amphoteric. Specific examples of such surfactants are described in "Kaimenkasseizai Handbook (Surfactant Handbook)" published by Kogaku Tosho.

Various compounds may be incorporated into the stabilizing bath for image stabilizing purposes. Typical examples of compounds useful for this purpose include a variety of buffering agents for adjusting the pH of hydrophilic colloidal layes (to the range, for example, of 3–8) as illustrated by borates, metaborates, borax, phosphates, carbonates, potassium hydroxide, sodium hydroxide, aqueous ammonia, monocarboxylic acids, dicarboxylic acids and polycarboxylic acids (which may be used in combination), as well as aldehydes such as formaldehyde. Other additives that may be used include chelatants, bactericides (e.g. thiazoles, isothiazoles, halo-phenols, sulfanylamides and benzotriazole), surfactants, brighteners and hardeners. Compounds for achieving the same or different purposes may be used as admixtures.

For the purpose of improving the storage stability of image, it is preferred to add various ammonium salts (e.g. ammonium chloride, ammonium nitrate, ammonium sulfate, ammonium phosphate, ammonium sulfite and ammonium thiosulfate) to processing solutions as agents to modify the pH of hydrophillic colloidal layers.

The temperature of the wash or stabilizing bath used in the method described above and the duration of time for the washing or stabilizing step are preferably in the ranges of from 0° to 50° C. and from 5 to 30 seconds more preferably in the ranges of 15°–40° C. and 5–20 seconds, with the ranges of 15°–40° C. and 5–10 seconds being particularly preferred.

According to the method of the present invention, the developed, fixed and washed photographic material is dried after passing through the squeezing step in which the wash water is removed by the squeeze roller method. The drying is effected at a temperature in the range of ca. 40–ca. 100° C. The drying time may vary as appropriate depending on the environmental condition and the duration of from about 5 seconds to 1 minute will normally suffice. More preferably, the drying is performed at 40°–80° C. for a period of ca. 5–30 seconds.

The present invention offers the added advantage that the time required to dry up photographic materials can be shortened.

According to the method of the present invention, the "drying-to-dry" processing time including development, fixing, washing and drying steps is preferably completed within 60 seconds, more preferably within 50 seconds. The term "dry-to-dry" as used hereinabove means the time from the moment the tip of the photographic material to be processed enters an automatic processor at the film inlet to the moment said tip emerges from the processor after processing.

The following examples are provided for the purpose of further illustrating the present invention but are in no way to be taken as limiting.

EXAMPLE 1

Silver chlorobromide grains containing 30 mol % AgBr were prepared in the presence of both $2\times10^{-7}$ moles of water-soluble iridium and $4\times10^{-8}$ moles of water-soluble rhodium per mole of silver, with EAg and pH being controlled at 120 mV and 3.0, respectively. The grains obtained were cubes with an average size of 0.30 μm and a size distribution spread of 11%. The area ratio of (100) faces to (111) faces was was 98/2. After adding 0.6 g of potassium bromide per mole of silver halide, the grains were subjected to gold and sulfur sensitization and thereafter mixed with a spectral sensitizer (A) (see below). Subsequently, 1 g of 4-hydroxy-6-methyl-1,3,3a, 7-tetrazaindene (stabilizer), 600 mg of sodium n-dodecylbenzenesulfonate, 2 g of a styrene-maleic acid copolymer and 3 g of a high polymer latex of ethyl acrylate were added. The resulting coating solution was applied onto a polyethylene terephthalate film (silver deposit, 3.5 g/m$^2$; gelatin deposit, 1.6 g/m$^2$) to form a silver halide emulsion layer. At the same time, a protective layer containing 30 mg/m$^2$ of sodium 1-decyl-2-(3-isopentyl) succinato-2-sulfonate (spreading agent), 30 mg/m$^2$ of 1-hydroxy-3,5-dichlorotriazine sodium salt (hardener) and 25 mg/m$^2$ of formaldehyde was coated in superposition on the film to give a gelatin deposit of 0.8 g/m$^2$, with the film being precoated with a backing layer for a gelatin deposit of 3.0 g/m$^2$.

In this way, samples of silver halide photographic material were prepared, each having the emulsion layer and the surface protective layer on one side of the support and the backing layer on the other side.

<A>

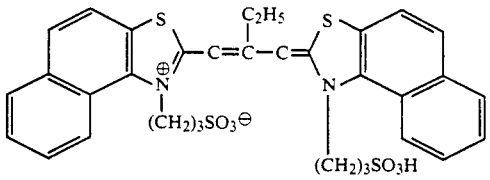

The samples were subjected to flash exposure for $10^{-5}$ second with a xenon flash through a contact screen (gray negative 150L), an optical wedge and a 680 nm interference filter. Thereafter, the exposed samples were processed with a developing solution and a fixing solution (for their recipes, see below) using a roller-type automatic processor under the conditions shown in Table 1. The processed samples were visually evaluated for color remnant by the following criteria: 1–4, unacceptable; 5–10, acceptable (10, excellent).

The results of fixation were evaluated by visually checking for the presence of residual silver halide after processing unexposed films.

The storage stability of the processed films was evaluated as follows: the processed films were stored at 50° C.×79% r.h. for 7 days, and the degree of color stain as measured with an optical densitometer was compared with the result for the unprocessed samples.

As one can see from Table 1, the samples processed in accordance with the present invention allowed for efficient removal of silver halide and had satisfactory storage stability.

In the experiment, the line speed for the same development time was varied by changing the depth of an associated vessel and the number of rollers used.

| Developer's recipe | |
|---|---|
| Composition (A): | |
| Pure water (deionized water) | 150 ml |
| Ethylenediaminetetraacetic acid disodium salt | 2 g |
| Diethylene glycol | 50 g |
| Potassium sulfite (55% w/v aq. sol.) | 100 ml |
| Potassium carbonate | 50 g |
| Hydroquinone | 15 g |
| 5-Methylbenzotriazole | 200 mg |
| 1-Phenyl-5-mercaptotetrazole | 30 mg |
| Potassium hydroxide | q.s. to provide pH of 10.4 after use |
| Potassium bromide | 4.5 g |
| Composition (B): | |
| Pure water (deionized water) | 3 ml |
| Diethylene glycol | 50 g |
| Ethylenediaminetetraacetic acid disodium salt | 25 mg |
| Acetic acid (90% aq. sol.) | 0.3 ml |
| 5-Nitroindazole | 110 mg |
| 1-Phenyl-3-pyrazolidone | 700 mg |

Just prior to the use of developing solution, composition (A) and composition (B) were successively dissolved in 500 ml of water and the mixture was worked up to 1,000 ml.

| Fixing solution's recipe | |
|---|---|
| Composition (A): | |
| Ammonium thiosulfate (72.5% w/v aq. sol.) | 240 ml |
| Sodium sulfite | 17 g |
| Sodium acetate ($3H_2O$) | 6.5 g |
| Boric acid | 6 g |
| Sodium citrate ($2H_2O$) | 2 g |
| Acetic acid (90% w/v aq. sol.) | 10.0 ml |

-continued

| Fixing solution's recipe | |
|---|---|
| Composition (B): | |
| Pure water (deionized water) | 17 ml |
| Sulfuric acid (50% w/v aq. sol.) | 4.7 g |
| Aluminum sulfate (aq. sol. containing 8.1% w/v of $Al_2O_3$) | 26.5 g |

Just prior to the use of fixing solution, composition (A) and composition (B) were successively dissolved in 500 ml or water and the mixture was worked up to 1,000 ml. The so prepared fixing solution and a pH of about 4.5. The following scheme was employed in the processing with the automatic processor:

| Steps | Processing scheme Temparature (°C.) | | Time (Sec) |
|---|---|---|---|
| Development | 38 | | 12 |
| Fixing | 38 | | 10 |
| Washing | 20 | | 8 |
| Drying | 60 | | |
| | | (Dry-to-dry) | 48 |

TABLE 1

| Sample No. | Discharge of circulating fixing solution (with the capacity of fixing bath taken as 100%) | Flow rate of discharged fixing solution, m/min | Line speed mm/min | Color remnant | Residual silver halide | Storage stability | Remarks |
|---|---|---|---|---|---|---|---|
| 1 | 20% | 30 | 800 | 1 | present | 0.18 | Comparison |
| | | | 1800 | 3 | present | 0.14 | Comparison |
| | | 60 | 800 | 2 | present | 0.15 | Comparison |
| | | | 1800 | 4 | present | 0.11 | Comparison |
| 2 | 60% | 60 | 800 | 6 | absent | 0.05 | Invention |
| | | | 1000 | 8 | absent | 0.03 | Invention |
| | | | 1500 | 8 | absent | 0.02 | Invention |
| | | | 1800 | 9 | absent | 0.02 | Invention |
| | | | 2400 | 10 | absent | 0.01 | Invention |
| | | 15 | 1800 | 5 | present | 0.18 | Comparison |
| 3 | 120% | 60 | 1800 | 10 | absent | 0.02 | Invention |

EXAMPLE 2

Additional samples were prepared as in Example 1 except that the AgCl content and the size of silver halide grains were changed as shown in Table 2 and that the ratio of (100) faces to (111) faces was changed as shown in Table 2 by controlling the pAg. The samples were then processed and evaluated as in Example 1.

Particularly good results were obtained when the samples that had a AgCl content of at least 50 mol %, an average grain size of no more than 0.4 μm and a (100) face to (111) face ratio of at least 5 were processed by the method of the present invention. Similarly good results were obtained when the fixing solution was replenished by an additional supply in an amount of no more than 0.3L per $m^2$ of the light-sensitive material to be processed or when the line speed was no slower than 1,000 mm/min.

TABLE 2

| Sample No. | AgCl content, mol % | Average grain size, μm | (100)/(111) ratio | Line speed mm/min | Replenishment of fixing solution ($L/m^2$) | Color remnant | Residual silver halide | Storage stability | Remarks |
|---|---|---|---|---|---|---|---|---|---|
| 21 | 30 | 0.25 | 85/15 | 1800 | 0.2 | 6 | absent | 0.06 | Invention |
| 22 | 50 | 0.6 | 90/10 | 1800 | 0.2 | 7 | " | 0.03 | Invention |
| 23 | 50 | 0.35 | 90/10 | 1800 | 0.2 | 7 | " | 0.03 | Invention |
| 24 | 50 | 0.25 | 80/20 | 1800 | 0.2 | 3 | " | 0.07 | Comparison |
| 25 | 50 | 0.25 | 85/15 | 1800 | 0.2 | 8 | " | 0.02 | Invention |
| 26 | 50 | 0.25 | 90/10 | 1800 | 0.2 | 8 | " | 0.02 | Invention |
| 27 | 50 | 0.1 | 90/10 | 1800 | 0.2 | 8 | " | 0.01 | Invention |
| 28 | 70 | 0.25 | 95/4 | 800 | 0.2 | 7 | " | 0.06 | Invention |
| | | | | | 0.5 | 7 | " | 0.05 | Invention |
| 29 | 70 | 0.25 | 96/4 | 1800 | 0.2 | 9 | " | 0.01 | Invention |
| | | | | | 0.5 | 9 | " | 0.01 | Invention |
| 30 | 98 | 0.25 | 98/2 | 1800 | 0.5 | 9 | " | 0.01 | Invention |

As described on the foregoing pages, the method of the present invention is capable of processing silver halide photographic materials within a shorter period of time with efficient removal of silver halide being insured during fixing. In addition, the processed photographic materials have good storage stability and produce image of reduced color remnant.

What is claimed is:

1. A method of processing an imagewise exposed silver halide photographic material that has photographic constituent layers on a side of a support with an automatic processor, comprising:

circulating a fixing solution in a fixing bath being discharged in a volume of 30–200% per minute of a capacity of said fixing bath and at a flow rate of not less than 20 m per minute, wherein said silver halide photographic material has a gelatin content of not more than 3.0 $g/m^2$ in said photographic constituent layers, and said photographic constituent layers comprise a silver emulsion layer which contains silver halide grains having a (100) face to (111) face area ratio of not less than 5.

2. A method according to claim 1 wherein the line speed of processing the silver halide photographic material with the automatic processor is at least 1,000 mm/min.

3. A method according to claim 1 wherein the line speed of processing the silver halide photographic material with the automatic processor is at least 1,800 mm/min.

4. A method according to claim 1 wherein the fixing solution is discharged in a volume that is 60–120% per minute of the capacity of the fixing bath.

5. A method according to claim 1 wherein the fixing solution is discharged at a flow rate of 40–200 m per minute.

6. A method according to claim 1 wherein the fixing solution is replenished with an additional supply of no more than 300 ml per square meter of the photographic material being processed.

7. A method according to claim 1 wherein the fixing solution has a pH of 4.3–5.5.

8. A method according to claim 1 wherein the fixing time is no longer than 20 seconds at a temperature of ca. 20°–50° C.

9. A method according to claim 1 wherein the fixing time is in the range of 5–15 seconds at a temperature of 30°–40° C.

10. A method according to claim 1 wherein the drying-to-dry time is no longer than 60 seconds.

11. A method according to claim 1 wherein the drying-to-dry time is no longer than 50 seconds.

12. A method according to claim 1 wherein the silver halide grains have an average size of no more than 0.4 μm.

13. A method according to claim 1 wherein said photographic constituent layers comprise a silver halide emulsion layer containing a silver halide emulsion with a silver chloride content of at least 50 mol %.

14. A method according to claim 1 wherein silver halide grains having a (100) face to (111) face area ratio of at least 5 account for at least 50% of all the silver halide grains present in either one of the silver halide emulsion layers.

15. A method according to claim 1 wherein the photographic constituent layers have a gelatin deposit of no more than 2.5 g.

16. A method according to claim 1 wherein the silver halide photographic material has a silver coat weight of at least 3.0 $g/m^2$.

17. A method according to claim 1 wherein the silver halide photographic material has on one side of the support the photographic constituent layers containing one or more silver halide emulsion layers.

* * * * *